United States Patent [19]

Held et al.

[11] Patent Number: 4,488,271

[45] Date of Patent: Dec. 11, 1984

[54] DEEP OCEAN WIDE BAND ACOUSTIC BAFFLE

[75] Inventors: Jimmy L. Held; Kenneth D. Collins; Gerald R. Mackelburg, all of San Diego, Calif.

[73] Assignee: The United States of America as represented by the Secretary of the Navy, Washington, D.C.

[21] Appl. No.: 505,589

[22] Filed: Jun. 20, 1983

[51] Int. Cl.[3] ..... H04R 17/00

[52] U.S. Cl. ..... 367/151; 367/172; 367/176; 367/153

[58] Field of Search ..... 367/141, 153, 151, 157, 367/162, 167, 172, 176; 310/326, 337, 327

[56] References Cited

U.S. PATENT DOCUMENTS

| | | | |
|---|---|---|---|
| 2,473,971 | 6/1949 | Ross | 367/162 |
| 2,795,709 | 6/1957 | Camp | 367/162 |
| 3,038,551 | 6/1962 | McCoy et al. | 181/0.5 |
| 3,185,868 | 5/1965 | Coyle et al. | 310/8.2 |
| 3,274,537 | 9/1966 | Toulis | 340/8 |
| 3,302,163 | 1/1967 | Andrews | 340/8 |
| 3,372,370 | 3/1968 | Cyr | 340/8 |
| 3,375,489 | 3/1968 | Kompanek | 340/11 |
| 3,515,910 | 6/1970 | Fritz et al. | 310/8 |
| 3,699,507 | 10/1972 | Massa | 340/8 S |
| 3,925,692 | 12/1975 | Leschek et al. | 310/8.7 |

*Primary Examiner*—Harold J. Tudor

*Attorney, Agent, or Firm*—Robert F. Beers; Ervin F. Johnston; Thomas Glenn Keough

[57] ABSTRACT

A hydroacoustic transducer provides an improved hemispherical radiation pattern throughout a wide range of operating depths. A can-shaped transducer is nestled in the inside of a hat-shaped array of hollow spheres. Resiliently mounting the spheres with respect to each other and a hat-shaped shell holds the array away from the surface of the transducer and layering the hollow spheres assures the hemispherical pattern. Fashioning the spheres from hemispherical shells of aluminum and bonding them together makes the array insensitive to greater or lesser hydrostatic pressures and potting the array in polyurethane presents a more rugged structure capable of withstanding the routine abuses of the ocean environment.

11 Claims, 4 Drawing Figures

FREQUENCY: 10kHz
TEST DISTANCE (METERS): 4.00
SCALE: 1dB PER RADIAL DIVISION

UNIT ROTATED ABOUT THE Z AXIS
TEMP: 16.5C.
DEPTH: 6m.

3/4" BALLS POTTED 10 KHz
SCALE: 1 dB PER RADIAL DIVISION

DEEP OCEAN WIDE BAND ACOUSTIC BAFFLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Hydroacoustic transducers for operation in the transmitter or receiver mode have undergone a substantial evolution. Different frequency ranges of interest, sensitivities and range capabilities as well as increasing pressures and high speed platforms have caused transducers to be made in a wide variety of designs.

Transducers having ferroelectric or magnetostrictive active elements have enabled the coupling of acoustic energy in substantial amounts through differently shaped and sized projection surfaces. Generally speaking, most transducers, particularly ferroelectric and magnetostrictive designs, have a radiation pattern that is generally considered to be omnidirectional in character. Usually this is because the dimensions of the radiating surface of the transducer are small compared to the wavelength of sound in the ambient sound-propogating medium. The wavelength of sound is generally in the low kilohertz range and below so that many if not all transducers, standing alone, have a small dimensioned radiating surface with respect to the transmitted acoustic signal. Since this is the case, it naturally follows that the radiation patterns will be omnidirectional.

A usual means for obtaining directivity with such transducers is by taking several of them and arranging them in phased arrays or providing a number of focusing lenses or reflectors. Usually, however, the arrays of transducers are themselves massive to create an even more ponderous and unmanageable apparatus. In addition, some of the equipments of the lenses or reflectors are fabricated to define cavities or compliant tubes that need pressure compensation for greater operational depths. A consequence of pressure compensation, of course, is to compromise the compliance of the lens structure so that the transducer response characteristic changes with changing depths.

A noteworthy example of an electromechanical transducer having cavities filled with a liquid is set forth in U.S. Pat. No. 3,274,537 by William J. Toulis. Hollow glass spheres are filled with air or compositions which would be characterized by compressibility that is substantially greater than the compressibility of the liquid within which they are immersed. The pressure compensation scheme of Toulis used to achieve pressure equalization relied upon a liquid filling that affect the transducer resonance. There was nothing critical about the orientation of the pressure-release-material filled compliant tubes within the transducer cavity. Resonance could be shifted in this manner with an omnidirectional response.

One way to avoid changes in resonance and response is disclosed in U.S. Pat. No. 3,375,489. Hollow steel glass or solid lead balls are placed in the inside of a transducer and function as support members to retain a space within the container that has a lower sound velocity than the sound velocity of the surrounding water medium. The omnidirectional response of this transducer is said to be substantially unchanged throughout a forseable deployment depth. Another approach was the use of microballoons formed of glass, ceramic or other non-organic materials that fill the interior of the electroacoustic transducer of R. J. Cyr in his U.S. Pat. No., 3,372,370. Pressure compensation using hollow spheres is provided for to enable a substantially uninterrupted projection irrespective of changing depths.

A baffle structure for an underwater transducer array of Frank Massa U.S. Pat. No. 3,699,507 has a number of rigid hollow capsules that are welded into rigid circular sleeves each housing a transducer. The capsules are provided to increase the front-to-back impedance to passage of sonic energy through the interstices and present a high acoustic impedance to prevent passage of interfering, out-of-phase acoustic energy from the back of the front of the array of transducer elements. The combined sonic radiation from the array of transducers produced a desired source level and directional radiation pattern. Acoustic coupling to the underwater environment without degradation by the adjacent transducer elements could be accomplished by a typical array of vibrational piston transducers since this arrangement avoided a degradation in acoustic coupling within the array that was otherwise caused by an interference between out-of-phase radiations from the front and back surfaces of vibrating transducers.

The broadband acoustic transducer of D. E. Andrews, Jr. in U.S. Pat. No. 3,302,163 had a number of very low acoustic impedance portions made up of soft pressure release materials to increase the bandwidths and directivity of an underwater acoustic transducer. The soft pressure release materials located in an outwardly flaring cone design with respect to a ferroelectric cylinder gave broadband as well as a directivity for response.

Thus there is a continuing need in the state-of-the-art for a single transducer element having a not unduly directional hemispherical response that is compact, uncomplicated and rugged in design and capable of responsive operation at changing depths.

SUMMARY OF THE INVENTION

The present invention is directed to providing an apparatus for blocking and reflecting acoustic energy projected by a transducer. A hat-shaped array of hollow, spherically-shaped elements is disposed about the transducer and a silicon rubber compound resiliently holds the element and hat-shaped array in a spaced apart relationship from one another. A potting compound about the spherically shaped elements affords protection to withstand the abuses of handling and deployment and fashioning the spherically-shaped elements from aluminum hemispheres and arranging them in discrete layers provides for responsive operation irrespective of changing ambient pressures.

A prime object of the invention is to provide an apparatus for making a single element transducer directional.

Another object is to provide a single element transducer having a directional pattern that is relatively unaffected by changing ambient pressures.

Yet another object is to provide an acoustic baffle for a transducer fabricated from an array of hollow aluminum spheres.

Still another object of the invention is to provide an acoustic baffle of hollow aluminum spheres arranged in a predetermined pattern to assure a hemidirectional response.

Still another object of the invention is to provide an acoustic baffle made up of an arrangement of hollow aluminum spheres that are potted to maintain a hat-shape and to withstand environmental abuses.

Yet a further object is to provide a hydroacoustic transducer that is of compact size while having a hemispherical directional capability.

Yet another object is to provide a hydroacoustic transducer having a directional pattern that is substantially unaffected by changing depths.

Still another object of the invention is to provide an acoustic baffle for a single transducer element fabricated from hollow aluminum spheres to provide a pressure insensitive directional pattern.

Yet another object is to provide a hydroacoustic transducer of reduced complexity and ruggedness to assure trouble-free operation.

A further object is to provide a directional capability for an omnidirectional transducer that is compact.

Other objects, advantages and novel features of the invention will become apparent from the following detailed description of the invention when considered in conjunction with the accompanying drawings.

DESCRIPTION OF THE PREFERRED EMBODIMENT

Figure 1:
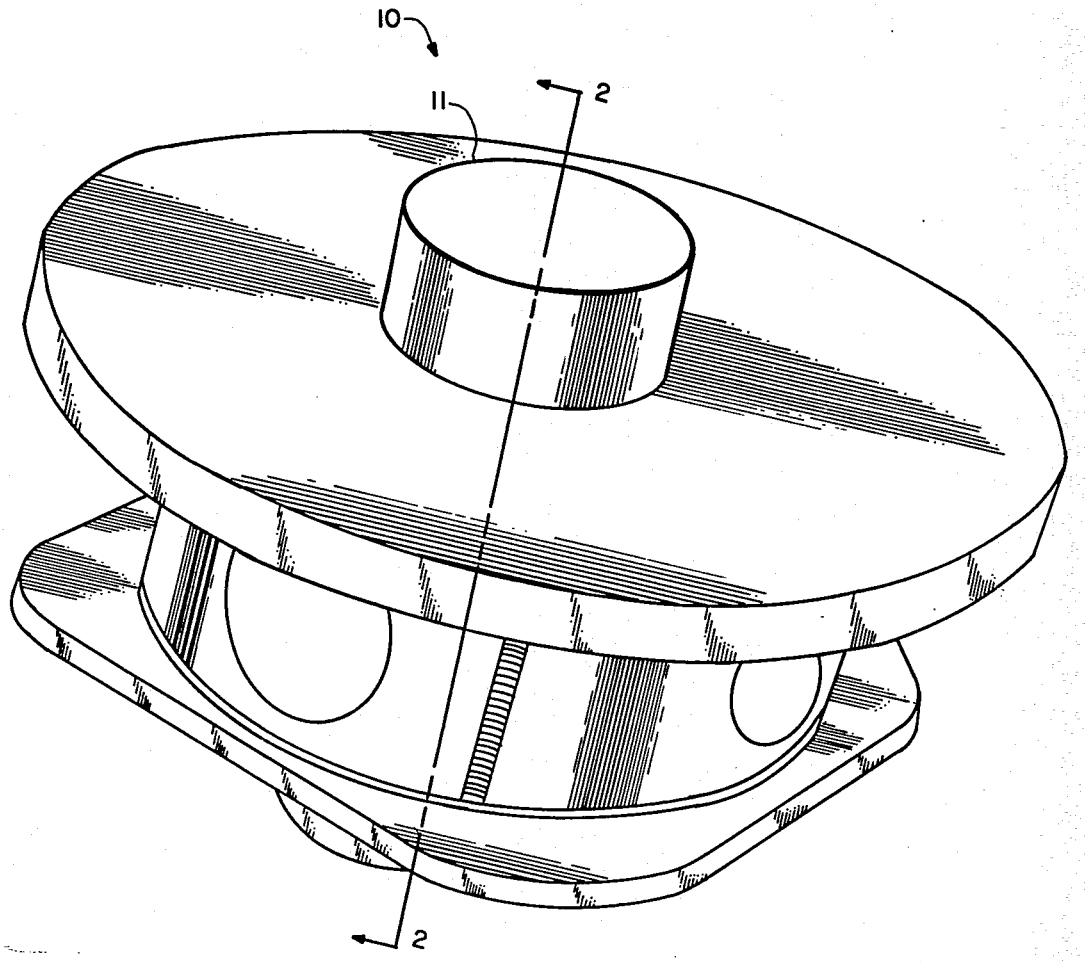
FIG. 1 depicts an isometric representation of the hydroacoustic transducer provided with the acoustic baffle.

Referring now to the drawings, and in particular FIG. 1, a combined hydroacoustic transducer and baffle 10 is shown having a hemispherical directional response that is substantially the same over a wide frequency range over a wide range of depths. The transducer and baffle fabricated in accordance with the teachings of this inventive concept provide a high data rate acoustic communication to at least a plus and minus 45° angle from the transducer centerline in depths up to 20,000 feet. The frequency range of interest is between 8 kHz and 14 kHz and within this band of interest a transducer 11 radiates in accordance with appropriate driving signals.

Figure 3:
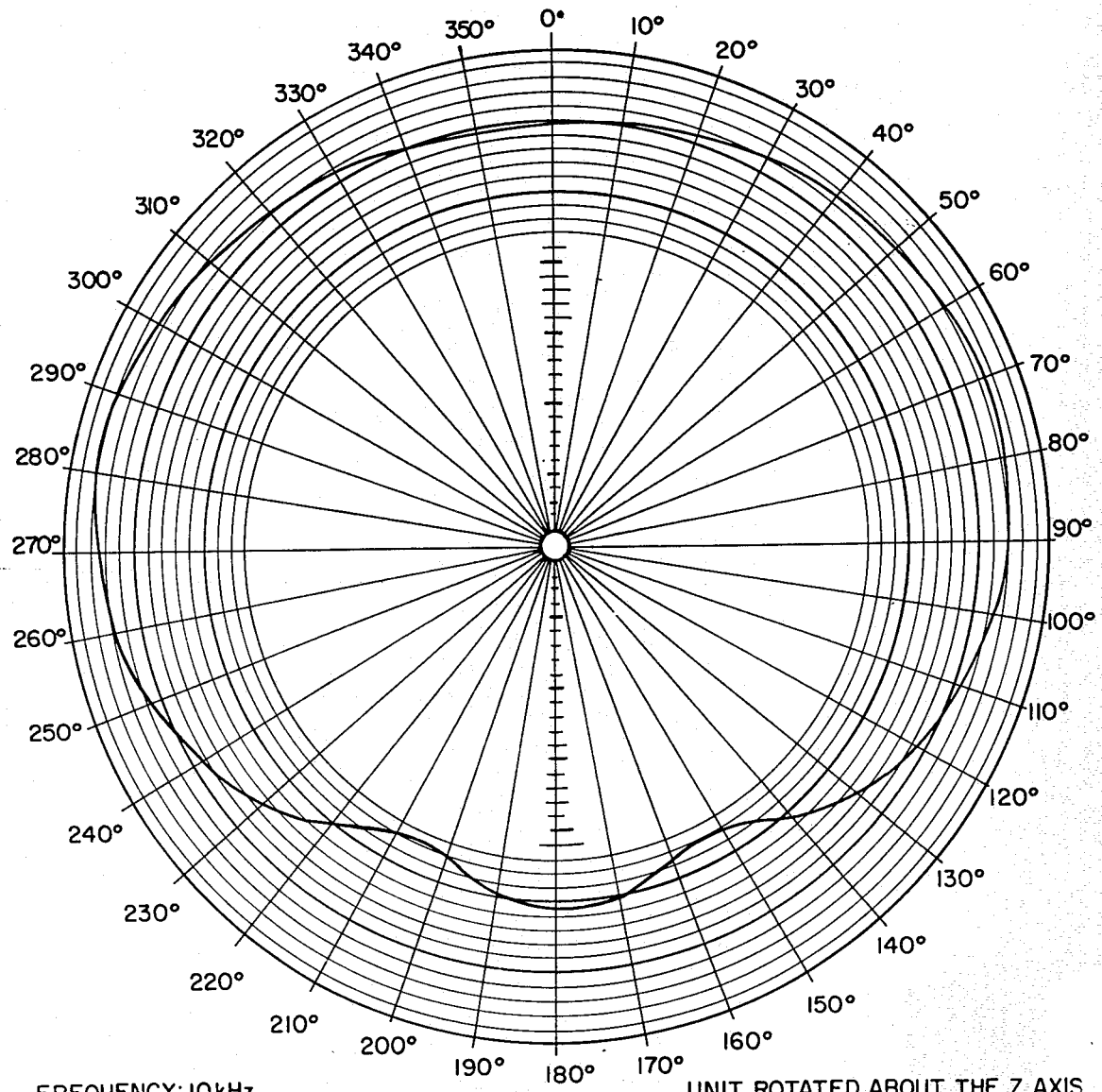
FIG. 3 is a graphical depiction of the transducer projection response without the acoustic baffle.

The transducer selected is a ring ceramic transducer purchased from ITC (International Transducer Corp.) of Goleta, Calif. This transducer has a very broad response across all frequencies of interest. The transducer can be said to be nearly omnidirectional since it has only a 3 dB reduction in sound retransmitted out its back. The response of the transducer standing by itself is shown in FIG. 3. The radiated power is in the range of 10–100 watts and can be considered as radiated uniformly.

The design of this invention evolved from the need for a sound source to be mounted on an undersea vehicle; it is necessary that the transducer be able to transmit away from the vehicle at least in a hemispherical pattern that is at least ten decibels greater than the front-to-back transmission ratio within the transducer itself. The reason this is critical is that if the sound transmitted out the back of the transducer is not diminished, this back transmitted sound might be reflected off the sea floor and can create a multipath to a remotely disposed receiver. This mixture of signals would mix with the direct path signals and consequently generate errors in the transmitted data.

Transducer arrangements are available which have an acceptable front-to-back ratio yet are too narrow in their projection response (about 20°), they do not exhibit a wide enough beam pattern to allow tracking and communication with an undersea vehicle and tend to degrade in performance at the higher end of the transmitted frequency band.

As noted above, the transmission pattern of the selected transducer is substantially omnidirectional. The projected beam pattern of this design truly can be said to be omnidirectional since there is little variation throughout the 360° angle. The apparatus of this inventive concept modifies the transducer's radiation pattern to give a nearly hemispherically-shaped radiation pattern.

Figure 2:
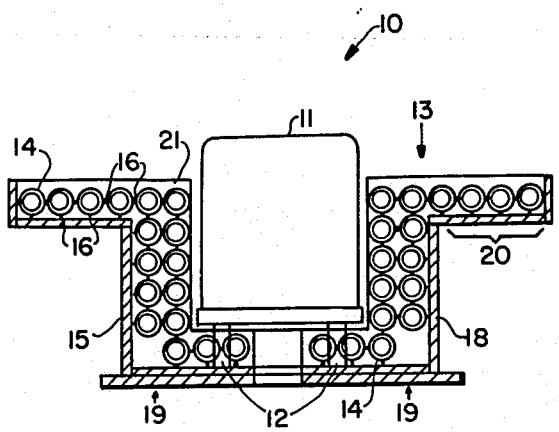
FIG. 2 is a cross-sectional representation taken along lines 2–2 in FIG. 1 showing the hat-shaped configuration of hollow aluminum spheres.

Looking to FIG. 2 of the drawings, it was discovered that the projection pattern of the transducer could be modified by mounting it by at least one mounting pin 12 slightly spaced from a specifically designed acoustic baffle 13. The baffle has a hat-shaped configuration and is made up of a number of discretely arranged hollow spheres 14. A hat-shaped shell 15 houses the hollow spheres and protects them from the abuses expected in the hostile marine environment. Mounting flanges, not shown, are provided to suitably anchor the transducer and baffle on the outside of an undersea vehicle. The shell is made up of a suitably treated material or a non-corrosive material such as polyvinylchloride and pins 12 that locate transducer 11 in the center of that hat-shaped baffle are suitably treated to make them noncorrosive with the hostile marine environment.

Since the wavelength of interest lies between 8 and 14 kHz the dimeter of the spheres is critical. The wavelength of sound in air was calculated for a 13.7 kHz transmission and found to be twice the inside diameter of two-inch spheres. Having the spheres so dimensioned might cause resonance at this frequency and consequently cause decreased performance. The diameter of the spheres, therefore, must be smaller than our smallest wavelength which is about 0.97 inches. Three-quarter inch diameter aluminum spheres having wall thicknesses of about 0.05 inches were found to be acceptable for the frequency range of interest. Hemispherically-shaped shells were machined out of aluminum stock and bonded together with a commerical adhesive applied along their flat machined edge of the hemispherical shells. After the adhesive cured, the spheres were ready to assemble in a hat-shaped array configuration.

A silicon compound, such as the commercially known product, RTV, was applied at tabs 16 where adjacent spheres might otherwise touch or where they would touch the inside of the hat-shaped shell. The silicon tabs resiliently mounted the spheres and shell with respect to one another and prevented the spheres from actually touching one another.

A single layer of the spheres are located where the top or crown area of the hat-shaped baffle would be. and helped provide a hemispherical directional pattern. Two layers 19 of spheres are arranged in a pair of coaxial layers about the transducer inside of the shell area generally designated by 18 to further aid the transmission pattern and a brim portion 20 of four coplanar, coaxially larger rings of spheres improved the transmission of the above identified transducer to that depicted in FIG. 4. Departing from this specific configuration of hollow spheres altered the radiation pattern of the transducer and created an objectionable level of back transmitted sound. Suitably dimensioned steel titanium, glass and ceramic hollow spheres might be substituted but the aluminum spheres have proven themselves acceptable.

Holding all the spheres in close proximity around the transducer was partially accomplished by the RTV tabs holding the spheres together on the inner wall of the hat-shaped shell; however, the hollow spheres were exposed to the corrosive effects of seawater and quickly corroded and had excessive RTV hardening on them to alter the transmission characteristic of the transducer and baffle combination. The arrangement of spheres within the hat-shaped shell was encapsulated by casting them in a soft, fast-curing and nonviscous casting material 21 that is compatible with the silicon compound aluminum spheres and polyvinylchloride case. A commercially available polyurethane marketed under the tradename Zipper Tube 15 minute-cure 60 shore polyurethane was acceptable. This addition to the baffle solved the corrosion and hardening problem as well as making the overall structure more rugged and less susceptible to damage.

Figure 4:
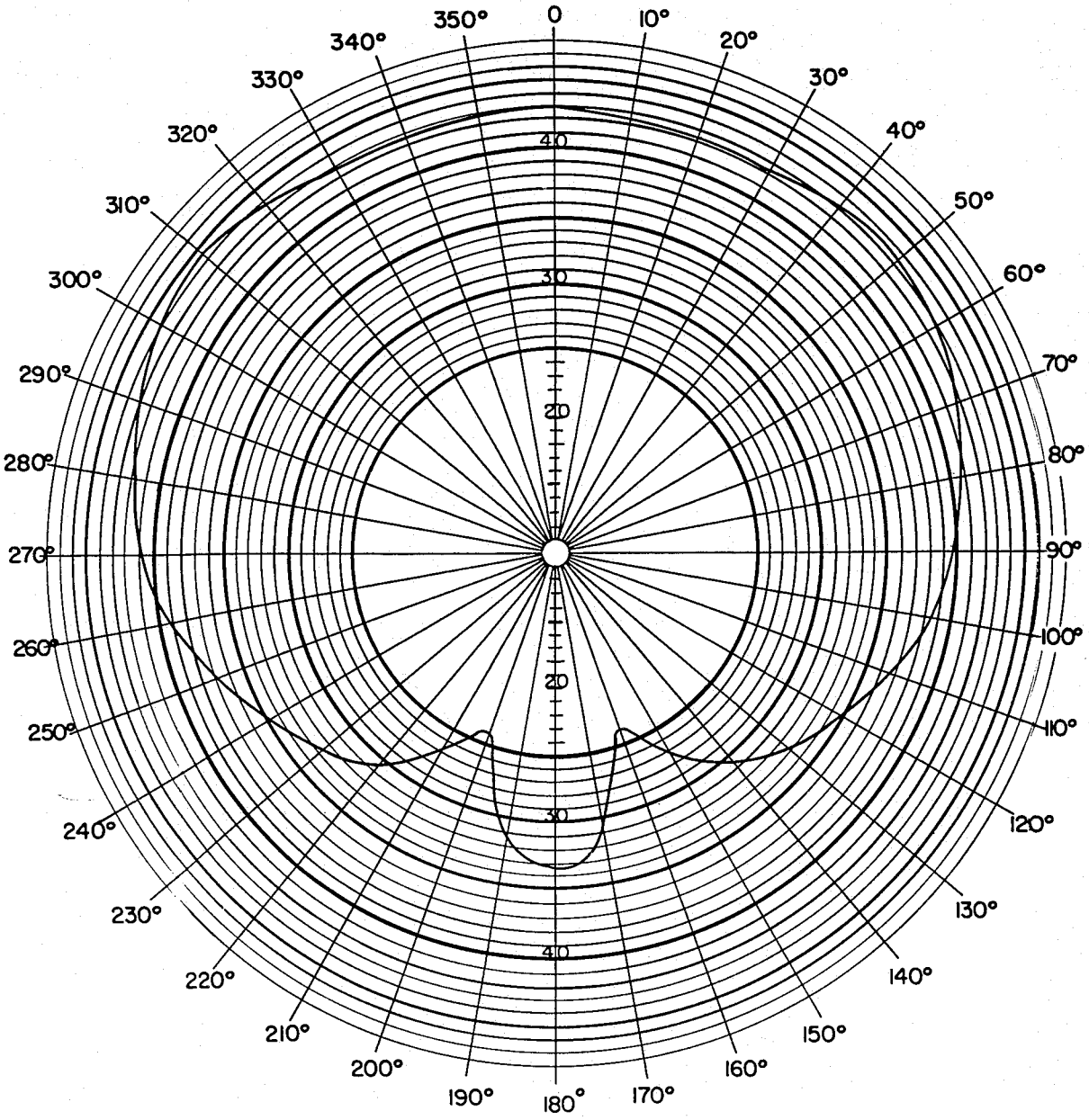
FIG. 4 shows the response of the transducer having the hat-shaped acoustic baffle in accordance with the teaching of this invention.

The hat-shaped array of hollow spherical shells nestles the transducer such that the projection pattern is substantially as shown in FIG. 4. Various sized hollow spheres and manufacturing techniques were used as well as different arrangements of the spheres around the transducer. The hat-shaped array arranged and dimensioned as set out above gave a desired tracking and communication capability for an undersea vehicle. The projected pattern allowed maneuvering flexibility while at the same time permitting reduced distortion transmission.

Obviously many modifications and variations of the present invention are possible in the light of the above teachings. It is therefore to be understood that within the scope of the appended claims the invention may be practiced otherwise than as specifically described.

What is claimed is:

1. An apparatus for blocking and reflecting acoustic energy projected by a transducer comprising:

means nestling the transducer therein providing an array of hollow spherically-shaped elements for blocking and reflecting acoustic energy arranged in a hat-shaped configuration and arranged to at least one-layer thickness of hollow spherically-shaped elements throughout the hat-shaped array;

means coupled to the hollow spherically-shaped elements for resiliently mounting the hollow spherically-shaped elements with respect to each other; and means disposed in contact with the hollow spherically-shaped elements and the resiliently mounting means for maintaining the hat-shaped array configuration and the nestled transducer therein, the transducer is essentially cylindrical in shape and the hollow spherically-shaped elements are arranged in a one-layer thickness where a crown area of the hat-shaped array would be located, a two-layer thickness coaxially from the transducer and a four-layer coaxial, coplanar arrangement where a brim of the hat-shaped array would be located.

2. An apparatus according to claim 1 in which the acostic energy is between eight and fourteen kilohertz and the hollow spherically-shaped elements are hollow aluminum spheres each having a three-quarter of an inch diameter.

3. An apparatus according to claim 2 in which each of the hollow aluminum spheres are fabricated from two hemispherically-shaped shells bonded together and having a wall thickness of about five-hundredths of an inch.

4. An apparatus according to claim 3 further including:

means for defining a hat-shaped form disposed about the arrangement of hollow spherically-shaped elements and the transducer.

5. An apparatus according to claim 4 in which the resiliently mounting means is a silicon rubber compound interposed between adjacent hollow spherically-shaped elements and the hat-shaped form defining means to resiliently position and acoustically separate one from the other.

6. An apparatus according to claim 5 further including:

means coupled to the hat-shaped form defining means for positioning the transducer separated from the hat-shaped array of hollow spherically shaped elements.

7. An apparatus according to claim 6 in which the hat-shaped form defining means and the transducer positioning means are fabricated from materials which approximates the acoustic properties of water.

8. An apparatus according to claim 7 in which the hat-shaped form defining means is a polyvinylchloride shell disposed about the hat-shaped array.

9. An apparatus according to claim 8 in which the transducer positioning means is at least one rod coupled to the transducer and the polyvinylchloride shell.

10. An apparatus according to claim 9 in which the maintain means is a cured polyurethane potting compound that holds the arrangement of hollow spherically-shaped elements about the transducer.

11. An apparatus according to claim 1 in which the hollow spherically-shaped elements optionally are suitably dimensioned steel, titanium, glass, and ceramic hollow spheres.

* * * * *